US006395404B1

(12) United States Patent
Kato et al.

(10) Patent No.: US 6,395,404 B1
(45) Date of Patent: May 28, 2002

(54) BLANK USED FOR MANUFACTURING SINGLE-HEADED PISTON, AND METHOD OF PRODUCING THE BLANK

(75) Inventors: Takayuki Kato; Masato Takamatsu; Seiji Katayama; Shigeo Fukushima, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 20 days.

(21) Appl. No.: 09/583,119

(22) Filed: May 30, 2000

(30) Foreign Application Priority Data

May 31, 1999 (JP) ..... 11-152239

(51) Int. Cl.[7] ..... F04B 39/00
(52) U.S. Cl. ..... 428/582; 428/577; 428/583
(58) Field of Search ..... 29/888.04, 888.042; 428/577, 586, 579, 582, 583, 584, 585

(56) References Cited

U.S. PATENT DOCUMENTS 5,174,728 A * 12/1992 Kimura et al. ..... 417/222.2
5,868,556 A * 2/1999 Umemura ..... 417/269
5,913,960 A * 6/1999 Fletcher-Jones ..... 92/219
5,960,542 A * 10/1999 Umemura et al. ..... 29/888.04
6,217,295 B1 * 4/2001 Kato et al. ..... 417/269
6,266,878 B1 * 7/2001 Durkin et al. ..... 29/888.044

FOREIGN PATENT DOCUMENTS

| | | |
|---|---|---|
| JP | A-9-256952 | 9/1997 |
| JP | A-10-159725 | 6/1998 |
| JP | 11-303747 | * 11/1999 |
| JP | 2000-038987 | * 2/2000 |

* cited by examiner

*Primary Examiner*—John J. Zimmerman
(74) *Attorney, Agent, or Firm*—Woodcock Washburn LLP

(57) ABSTRACT

Method of producing a blank for manufacturing a single-headed piston having a head portion and a neck portion formed integrally with the head portion, for engagement with a drive member, the method including: a step of manufacturing a body member including a twin neck section and two cylindrical hollow head sections formed integrally with the twin neck section so as to extend from opposite ends of the twin neck section, the twin neck section consisting of two portions which are mutually integrally formed in series with each other and which correspond to the neck portions of respective two single-headed pistons, each hollow head section being open at at least one of opposite ends thereof which is remote from the twin neck section; a step of manufacturing two closing members each for closing an open end of the corresponding hollow head section; and a step of fixing each closing member to the body member, so as to close the open end of the corresponding hollow head section.

15 Claims, 12 Drawing Sheets

BLANK USED FOR MANUFACTURING SINGLE-HEADED PISTON, AND METHOD OF PRODUCING THE BLANK

This application claims priority under 35 U.S.C. §119 to Japanese patent application no. 11-152239 filed May 31, 1999.

BACKGROUND OF THE INVENTION

1. Field of the Invention

The present invention relates to a method of producing a blank used for manufacturing a single-headed piston, and more particularly to techniques for reducing the weight of the blank.

2. Discussion of the Related Art

A single-headed piston is used in a swash plate type compressor, as described in JP-A-9-256952, for example. The single-headed piston disclosed in this publication includes a head portion, and a neck portion formed integrally with the head portion. The head portion is axially movably fitted in a cylinder bore formed in a housing of the compressor, while the neck portion engages the opposite surfaces of a swash plate of the compressor through a pair of shoes such that the swash plate is movable relative to the neck portion, so that the single-headed piston is reciprocated by rotation of the swash plate to effect suction and compression of a gas.

The publication identified above proposes a method of producing two single-headed pistons from one blank. The method includes steps of: forming by casing or forging a blank wherein two neck portions for the two single-headed pistons are integrally formed in series arrangement in the axial direction of the blank; machining the outer circumferential surfaces of head portions and the other portions of the blank; applying a coating to the outer surface of the starting blank; grinding the outer circumferential surfaces of the head portions; cutting the starting blank into two pieces, namely, the two single-headed pistons. In this method, the blank consists of two sections which correspond to the respective two single-headed pistons and whose neck portions are arranged in series connection with each other in the axial direction, so that the productivity of the blank per se is improved. In addition, the method permits easy and efficient machining, coating (e.g., forming a polytetrafluoroethylene film) and other operations to be performed on the blank, since these operations are performed simultaneously on the two sections of the blank for the respective two single-headed pistons. Further, the method permits easy and stable grinding operations on the outer circumferential surfaces of the two head portions, by a centerless grinder, since the blank has a sufficiently large distance between the two head portions.

JP-A-10-159725 proposes a method of producing a single-headed piston which uses a hollow head portion, for the purpose of reducing the weight of the piston. Described in detail, the head portion includes a cylindrical container portion which is closed at one of its opposite ends and open at the other end, and a closure member which closes the open end of the cylindrical container portion. The open end of the container portion is closed by first fitting the closure member in the opening of the container portion and then fixing the closure member in the opening by calking the edge of the open end. This single-headed piston, whose head portion is hollow, has a reduced weight. Although the piston consists of two members one of which includes the neck portion and the container portion and the other of which is the closure member, there is not a risk that the closure member is removed upon compression of the gas by the piston, since a force produced by compression of the gas acts on the closure member in a direction that causes the closure member onto the container portion. During reciprocation of the single-headed piston, an inertial force acts on the closure member in a direction that causes the closure member to be moved away from the container portion. However, there is not a risk that the closure member is removed from the container portion, since the mass of the closure member is small and the inertial force is accordingly small. The single-headed piston receives a side force from the swash plate during the reciprocation, in a direction perpendicular to the direction of reciprocation. But, a bending moment based on this side force is small at the position of the closure member, and therefore there is not a risk that the closure member is removed due to the bending moment.

However, the blank for the single-headed pistons used in the method disclosed in JP-A-9-256952 is heavy, and it is difficult to reduce the weight of each single-headed piston produced according to this method. On the other hand, the method disclosed in JP-A-10-159725 has a risk that the closure member is rotated relative to the cylindrical container portion during an operation to machine the outer circumferential surface of the blank after the closure member is fixed to the container portion by calking. JP-9-256952 teaches the provision of a holding portion on the closure member, as an example of chucking means for the blank, so that the blank is chucked at the holding portion for transmitting a torque to the blank for rotating the blank during the machining operation. However, the force by which the closure member is fixed to the container portion by calking is not sufficient to withstand the torque applied to the closure member, whereby the closure member may be rotated relative to the container portion, causing the blank to be damaged.

Although the methods described above apply to the compressors of swash plate type in which the neck portion of the piston engages the opposite surfaces of the swash plate through the shoes, problems similar to those described above may be encountered with respect to a method of producing a blank for the single-headed piston used in compressors other than the swash plate type, such as wave cam type compressors. The term "single-headed piston" used herein is collectively used to mean single-headed pistons used not only in the swash plate type compressors but also the other types of compressors. Accordingly, the term "neck portion" of the piston means a portion of the single-headed piston at which the piston engages a driving member or device.

SUMMARY OF THE INVENTION

The present invention was made in the light of the background prior art described above. It is a first object of the present invention to provide a method of producing a blank which permits easy manufacture of a hollow single-headed piston having a reduced weight. It is a second object to provide such a blank.

The first or second object indicated above may be achieved according to any one of the following forms or modes of the present invention, each of which is numbered like the appended claims and depends from the other form or forms, where appropriate, to indicate and clarify possible combinations of technical features of the present invention, for easier understanding of the invention. It is to be understood that the present invention is not limited to the technical features and their combinations described below. It is also to be understood that any technical feature described below in combination with other technical features may be a subject matter of the present invention, independently of those other technical features.

(1) A method of producing a blank for manufacturing a single-headed piston including a head portion and a neck portion which is formed integrally with the head portion, for engagement with a drive member, the method comprising the steps of: manufacturing a body member including a twin neck section and two cylindrical hollow head sections formed integrally with the twin neck section such that the two hollow head sections extend from opposite ends of the twin neck section, the twin neck section consisting of two portions which are mutually integrally formed in series with each other and which correspond to the neck portions of respective two single-headed pistons, each of the two hollow head sections being open at at least one of opposite ends thereof which is remote from the twin neck section; manufacturing two closing members each for closing an open end of a corresponding one of the two hollow head sections; and fixing each of the two closing members to the body member, so as to close the open end of the corresponding hollow head section.

According to the method according to the above form (1) of this invention, it is possible to produce a blank from which two single-headed pistons each including a light-weight head portion of hollow structure can be manufactured. Accordingly, the present method provides an advantage of facilitating operations to machine and coat the outer circumferential surfaces of the hollow head sections of the blank, and centerless grinding operations on those outer circumferential surfaces. Further, the blank consists of the integral body member the length of which is substantially the same as that of the blank, and the two closing members which are fixed to the respective opposite ends of the body member. This blank has a higher degree of dimensional accuracy with a reduced adverse influence by the accuracy of fixing of the closing members to the body member, and permits a reduction in the required amount of stock removal by the machining operation, as compared with a blank which consists of a twin neck section and two hollow head sections bonded to the respective opposite ends of the twin neck section. In addition, the amount of stock removal from the present blank in the machining operations is not restricted by a bending moment due to a cutting resistance inevitably generated in the machining operations, since the blank does not have any point of fixing or bonding of two sections thereof to each other, at the portion of the blank at which the bending moment is comparatively large. Consequently, the machining efficiency of the present blank can be easily improved. It is further noted that since the closing members of the present blank are fixed to the respective opposite ends of the body member, the closing member is located at one end of each single-headed piston manufactured from the present blank, so that a relatively small amount of positional error or deformation at the point of fixing of the closing member to the other portion of the piston will not have a significant influence on the dimensional accuracy of the single-headed piston even if such positional error or deformation takes place on the manufactured single-headed piston.

(2) A method according to the above form (1), wherein each closing member is formed such that each closing member includes a fitting portion having an outer circumferential surface to be fitted in an inner circumferential surface of the corresponding hollow head section, and each closing member and the body member are formed such that one of the outer circumferential surface of the fitting portion and the inner circumferential surface of the corresponding hollow head section has a projecting portion formed thereon so as to extend in an axial direction of the fitting portion and the corresponding hollow head section, while the other of the outer circumferential surface and the inner circumferential surface has a recessed portion for engagement with the projecting portion, the step of fixing each of the two closing members to the body member comprising fitting the fitting portion of each closing member in the corresponding hollow head section of the body member at the outer and inner circumferential surfaces while effecting engagement of the projecting and recessed portions with each other, to thereby prevent relative rotation of the body member and each closing member.

In the above form (2) of the present invention, each closing member is fitted at its outer circumferential surface in the inner circumferential surface of the body member, making it relatively easy to assure a high degree of concentricity of the closing member and the body member, thereby permitting the blank to have a high degree of dimensional accuracy as a whole. In addition, the relative rotation of each closing member and the body member is prevented by the engagement of the projecting and recessed portions with each other, facilitating the machining operation on the blank. For instance, each closing member may have a holding portion which extends from a central part of the outer end face remote from the body member, so that the blank is held by a suitable chuck at the holding portion of each closing member at each end of the blank. To perform the machining operation on the outer circumferential surfaces of the hollow head sections of the blank, the blank held by the chucks at the holding portions of the two closing members is rotated to machine the outer circumferential surfaces of the hollow head sections. In this case, the closing members and the body members are effectively prevented from being rotated relative to each other, by the mutually engaging projecting and recessed portions provided on one and the other of each closing member and the hollow head section. Accordingly, the machining operations can be effected with high efficiency.

The projecting portion includes at least one projection, while the recessed portion includes at least one recess. Preferably, the circumferential dimension of the projecting portion as measured in the circumferential direction of the closing member and the hollow head section is slightly larger than that of the recessed portion, so that the projecting and recessed portions engage each other with an interference fit therebetween, which is effective to assure complete prevention of the relative rotation of the body member and the closing member. Further, the interference fit between the projecting and recessed portions improves the strength of bonding of the closing member to the body member, making it possible to eliminate the need of establishing an interference fit between the outer circumferential surface of the fitting portion of the closing member and the outer circumferential surface of the hollow head section, or making it possible to reduce the required amount of interference between those outer and inner circumferential surfaces. Accordingly, the radially outward expansion of the hollow head section due to the interference fitting of the closing member in the hollow head section can be avoided, or the amount of that expansion can be reduced. As a result, the required amount of stock removal from the blank in the machining operations on the outer circumferential surfaces of the hollow head sections can be reduced, for example, and the required machining time can be accordingly reduced. In addition, the reduction of the strength of the stock due to the stock removal can be minimized.

(3) A method according to the above form (2), wherein at least one of the projecting and recessed portions has a guide portion at one end thereof at which the engagement of the projecting and recessed portions is initiated, the guiding portion being shaped to guide the projecting portion into the recessed portion.

The guiding portion permits smooth engagement of the projecting and recessed portions with each other. The guiding portion is effective particularly where the engagement of the projecting and recessed portions is effected with an interference fit therebetween.

(4) A method according to the above form (2) or (3), wherein the projecting portion is shaped such that a circumferential dimension of the projecting portion as measured in a circumferential direction of each closing member and the corresponding hollow head section increases in the axial direction from one end of the projecting portion at which the engagement of the projecting and recessed portions is initiated, toward the other end of the projecting portion.

In the method according to the above form (4), the recessed portion may have a constant circumferential dimension, or may alternatively be tapered with the circumferential dimension increasing with an increase in the circumferential dimension of the projecting portion.

Preferably, the circumferential dimension of the projecting portion at its end at which the engagement of the projecting and recessed portions is initiated is smaller than that of the recessed portion at its end at which the engagement is initiated. The shaping of the projecting portion according to the above form (4) is also effective particularly where the engagement of the projecting and recessed portions is effected with an interference fit therebetween, since the projecting portion can be easily press-fitted into the recessed portion.

(5) A method according to the above form (1), wherein each closing member is formed such that each closing member includes a fitting portion having an outer circumferential surface to be fitted in an inner circumferential surface of the corresponding hollow head section, and each closing member and the body member are formed such that one of the outer circumferential surface of the fitting portion and the inner circumferential surface of the corresponding hollow head section has a projection portion, while the other of the outer circumferential surface and the inner circumferential surface has a recessed portion for engagement with the projecting portion, the projecting and recessed portions being shaped such that the projecting portion is snapped into the recessed portion, with elastic deformation of at least one of the hollow head section and the fitting portion of each closing member in a radial direction thereof, and such that the engagement of the projecting and recessed portions prevents a relative movement thereof in a circumferential direction of the fitting portion and the corresponding hollow head section.

The recessed portion of the blank produced according to the above form (5) of the invention is dimensioned such that the recessed portion can accommodate the projecting portion in the axial and circumferential directions of the fitting portion of the closing member and the hollow head section. The elastic deformation of at least one of the hollow head section and the fitting portion takes place only when the fitting portion is fitted in the hollow head section while the projecting and recessed portions are brought into engagement with each other. After the projecting portion is snapped into the recessed portion, the above-indicated at least one of the hollow head section and the fitting portion is restored to its original state without elastic deformation. The engagement of the surfaces of the projecting and recessed portions which are perpendicular to the axial direction of the body member prevents removal of each closing member from the body member, while the engagement of the surfaces of the projecting and recessed portions which are parallel to the axial direction prevents relative rotation of the closing member and the body member.

At least one of the hollow head portion of the body member and the fitting portion of the closing member may have a cutout or cutouts or other means for facilitating the elastic deformation of the above-indicated at least one of the hollow head section and the fitting portion. For instance, the fitting portion of the closing member may be an annular fitting portion which has the projecting or recessed portion in the form of at least one projection or recess. In this case, the annular fitting portion may further have two cutouts formed on the circumferentially opposite sides of each projection or recess such that the cutouts have a depth from the annular end face of the annular fitting portion in the axial direction of the annular fitting portion, and are formed through the annular wall of the annular fitting portion in the radial direction. Alternatively, at least one of the outer circumferential surface of the annular fitting portion and the inner circumferential surface of the hollow head section has cutouts formed on the circumferentially opposite sides of each projection or recess. In the former case, when each part of the annular wall the elastic deformation of each part of the annular wall of the annular fitting portion which is located between the two cutouts is facilitated by the two cutouts. In the latter case where the cutouts are formed in at least one of the annular fitting portion and the hollow head section, when the parts of the other of the fitting portion and the hollow head section in which the projecting or recessed portion is formed are elastically deformed in the radial inward or outward direction, the cutouts permit elastic deformation in the opposite radial direction of the other parts of the above-indicated other of the fitting portion and the hollow head section, which other parts are circumferentially adjacent to the above-indicated parts. Thus, the elastic deformation of the above-indicated other of the fitting portion and the hollow head section is facilitated by the cutouts.

In the above form (5) of this invention, the fitting portion of each closing member can be fixed to the body member, so as to prevent relative rotation and axial movement of the closing member and the body member.

(6) A method according to the above form (1), wherein each closing member is formed such that each closing member includes a fitting portion having an outer circumferential surface to be fitted in an inner circumferential surface of the corresponding hollow head section, the fitting portion further having as the recessed portion at least one recess which is not continuous in a circumferential direction of the corresponding hollow head section, and the step of manufacturing a body member and the step of fixing each of the two closing members to the body member comprise fitting the fitting portion into the corresponding hollow head section, and forcing at least one part of the corresponding hollow head section corresponding to the at least one recess in a radially inward direction of the corresponding hollow head section by plastic deformation, to form as the projecting portion at least one projection which engages the at least one recess, respectively.

In the method according to the above form (6) of this invention, the at least one projection forced out so as to extend from the inner circumferential surface of the hollow head section of the body member is held in engagement with the at least one recess formed in the outer circumferential surface of the fitting portion of the closing member, so that the closing member can be fixed to the body member so as to prevent relative rotation and axial movement of the closing member and the body member.

(7) A method according to the above form (1), wherein each closing member is formed such that each closing includes a fitting portion having an outer circumferential surface to be fitted in an inner circumferential surface of the corresponding hollow head section, and the step of manufacturing a body member and the step of manufacturing two closing members comprise forming a multiplicity of projections on each of at least one of the outer circumferential surface of the fitting portion and the inner circumferential surface of the corresponding hollow head section over an entire circumference thereof, the step of fixing each of the two closing members to the body member comprising fitting the fitting portion in the inner circumferential surface of the corresponding hollow head section such that the multiplicity of projections formed on each of the at least one of the outer and inner circumferential surfaces are held in forced engagement with the other of the outer and inner circumferential surfaces, with an interference therebetween.

(8) A method according to the above form (7), wherein the multiplicity of projections are formed by knurling the at least one of the outer and inner circumferential surfaces over the entire circumference.

(9) A method according to the above form (7), wherein the multiplicity of projections are formed by serrating the at least one of the outer and inner circumferential surfaces over the entire circumference.

(10) A method according to any one of the above forms (1)–(9), wherein the step of fixing each of the two closing members comprises bonding each closing member to the body member by an adhesive agent.

Although only the bonding of the closing member to the body member by an adhesive or bonding agent permits the fixing of the closing member to the body member so as to prevent relative rotation and axial movement of the closing member and the body member, the arrangement according to any one of the above forms (2)–(9) together with the bonding assures complete prevention of the relative rotation and axial movement of the closing member and the body member. This also applies to the method according to the following forms (11) and (12).

(11) A method according to any one of the above forms (1)–(9), wherein the step of fixing each of the two closing members comprises bonding each closing member to the body member by an alloy having a melting point lower than those of the closing member and the body member.

(12) A method according to any one of the above forms (1)–(9), wherein the step of fixing each of the two closing members comprises welding each closing member to said body member.

The welding may be effected by various methods such as electron beam welding and laser beam welding, and at a reduced pressure or the atmospheric pressure. For instance, the electron beam welding may be effected at a reduced pressure, to avoid air expansion due to heat and to eliminate a need of evacuating the interior of the body member closed by the closing members, and a need of providing the piston with an air vent.

(13) A blank for manufacturing a single-headed piston including a head portion and a neck portion which is formed integrally with the head portion, for engagement with a drive member, the blank comprising: a body member including a twin neck section and two cylindrical hollow head sections formed integrally with the twin neck section such that the two hollow head sections extend from opposite ends of the twin neck section, the twin neck section consisting of two portions which are mutually integrally formed in series with each other and which correspond to the neck sections of two single-headed pistons, each of the two hollow head sections being open at at least one of opposite ends thereof which is remote from the twin neck section; and two closing members fixed to the body member such that each of the two closing members closes an open end of a corresponding one of the two hollow head sections.

The blank according to the above form (13) of this invention may have any one of the features included in the above forms (2)–(12) of the invention.

The above form (13) of the present invention has substantially the same advantages as described above with respect to the method according to the above form (1) of the invention. Where the blank includes any one of the features of the above forms (2)–(12), the blank provides the substantially the same advantages as described above with respect to those forms (2)–(12) of the invention.

(14) A method of producing a blank for manufacturing a single-headed piston including a head portion and a neck portion which is formed integrally with the head portion, for engagement with a drive member, the method comprising the steps of: manufacturing a body member including a neck section and a hollow head section which is formed integrally with the neck section and which is open at one of opposite ends thereof which is remote from the neck section, the body member having one of a projecting portion and a recessed portion; manufacturing a closing member for closing an open end of the hollow head section, the closing member having the other of the projecting and recessed portions; and fixing the closing member to the body member such that relative rotation of the body member and the closing member is prevented by engagement of the projecting and recessed portions.

The method according to the above form (14) of this invention may have any one of the features included in the above forms (3)–(11) of the invention.

The method according to the above form (14) has substantially the same advantages as described above with respect to the above forms (1) and (2), except for the advantage relating to the manufacture of two single-headed pistons from the single blank. Where the present method includes any one of the features of the above forms (3)–(11), the method provides substantially the same advantages as described above with respect to those forms (3)–(11) of the invention. The same applies to the following form (15) of the invention.

(15) A blank for manufacturing a single-headed piston including a head portion and a neck portion which is formed integrally with the head portion, for engagement with a drive member, the blank comprising: a body member including a neck section and a hollow head section which is formed integrally with the neck section and which is open at one of opposite ends thereof which is remote from the neck section, the body member having one of a projecting portion and a recessed portion; and a closing member which closes an open end of the hollow head section and which has the other of the projecting and recessed portions, the closing member being fixed to the body member such that relative rotation of the body member and the closing member is prevented by engagement of the projecting and recessed portions.

The blank according to the above form (15) of this invention may include any one of the features of the above forms (3)–(11).

BRIEF DESCRIPTION OF THE DRAWINGS

The above and optional objects, features, advantages and technical and industrial significance of the present invention will be better understood and appreciated by reading the following detailed description of presently preferred embodiments of the invention, when considered in connection with the accompanying drawings, in which.

DETAILED DESCRIPTION OF THE PREFERRED EMBODIMENTS

Referring to the accompanying drawings, there will be described presently preferred embodiments of this invention as applied to blanks used for manufacturing a single-headed piston in a swash plate type compressor used for an air conditioning system of an automotive vehicle.

Figure 1:
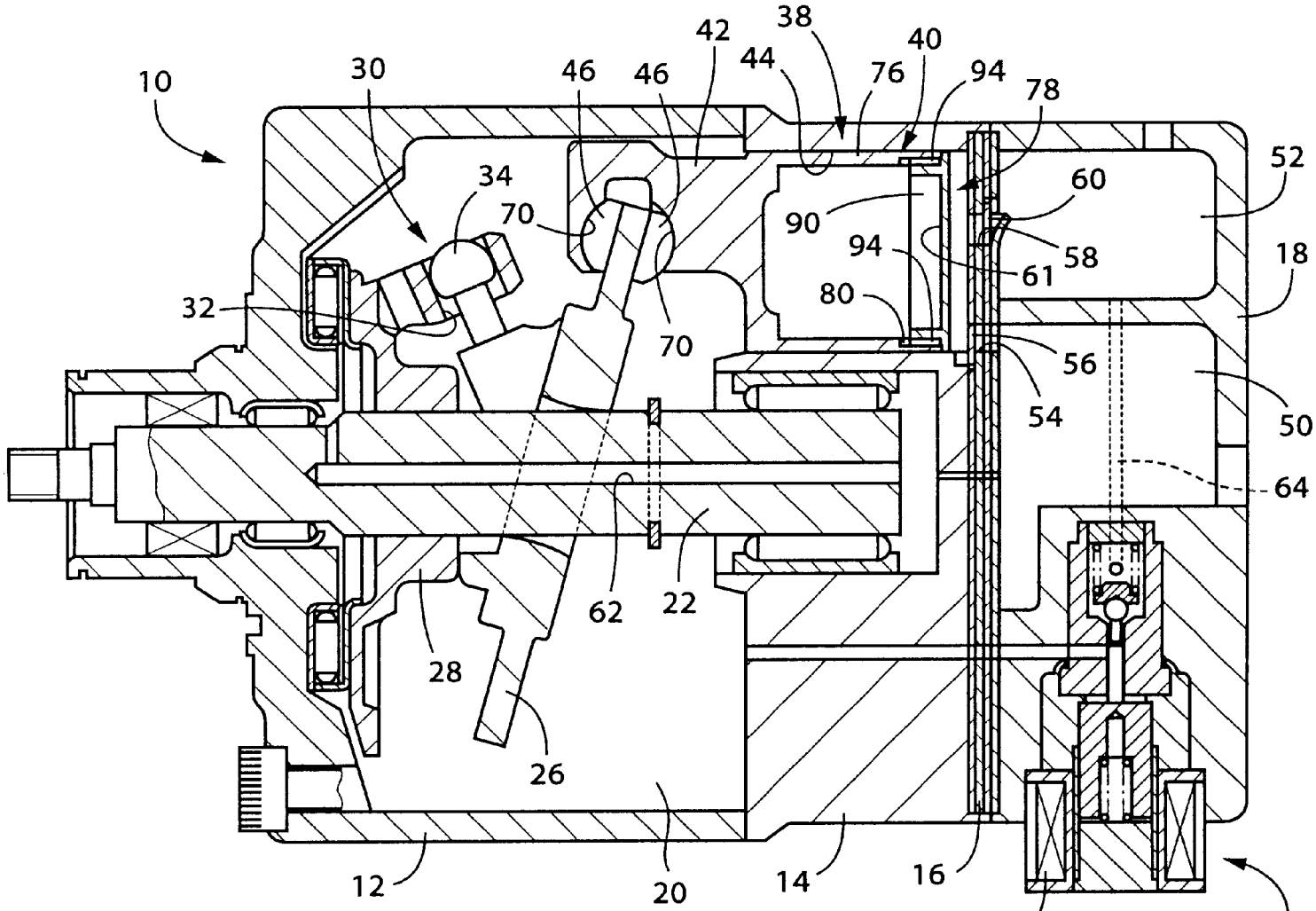
FIG. 1 is a front elevational view in cross section of a swash plate type compressor equipped with a single-headed piston manufactured from a blank produced by a method according to one embodiment of this invention.

In FIG. 1, reference numeral 10 denotes a housing. The housing 10 consists of a plurality of members assembled together, for easier manufacture of the housing 10. In the present embodiment, the housing 10 consists of a front housing 12, a cylinder block 14, a valve plate structure 16 and a rear housing 18, which are assembled together into a unitary structure in the form of the housing 10.

The front housing 12 and the cylinder block cooperate with each other to define a crank chamber 20 in which a rotary drive shaft 22 is disposed. The drive shaft 22 is rotatably supported at its opposite end portions by the front housing 12 and the cylinder block 14, and is operatively connected, through a clutch mechanism such as an electromagnetic clutch, to an external drive source (not shown) in the form of an an engine of an automotive vehicle. In operation of the compressor, the drive shaft 22 is connected through the clutch mechanism to the vehicle engine in operation, so that the drive shaft 22 is rotated about its axis.

A swash plate 26 is supported by the rotary drive shaft 22 such that the swash plate is axially movable and tiltable relative to the drive shaft 22. A rotary motion of the drive shaft 22 is transmitted to the swash plate 26, through a torque transmitting member 28 and a hinge mechanism 30 which are fixed to the drive shaft 22. The hinge mechanism 30 has an engaging hole 32 formed in the torque transmitting member 28, and an engaging protrusion 34 formed as an integral part of the swash plate 26. The engaging protrusion 34 is held in engagement with the engaging hole 32, for transmitting the rotary motion of the drive shaft 22 to the swash plate 26, while permitting a movement of the swash plate 26 relative to the drive shaft 22 in the axial direction and an inclination of the swash plate 26 relative to the axis of the drive shaft 22. A plurality of single-headed pistons 38 (hereinafter referred to simply as "pistons 38") are provided in engagement with a radially outer portion of the swash plate 26. In FIG. 1, only one piston is shown. Each piston 38 includes a head portion 40, and a neck portion 42 formed integrally with the head portion 40. The head portion 40 of each piston 38 is fitted in the corresponding one of a plurality of cylinder bores 44 formed in the cylinder block 14, such that the head portion 40 is axially movable relative to the cylinder block 14. The neck portion 42 engages the radially outer portion of the swash plate 26 through a pair of shoes 46 such that the swash plate 26 is slidable relative to the neck portion 42. The piston 38 is reciprocated by rotation of the swash plate 26. The plurality of cylinder bores 44 are formed along a circle whose center lies on the axis of rotation of the rotary drive shaft 22, such that the cylinder bores 44 are equiangularly spaced from each other in the circumferential or rotating direction of the drive shaft 22, in this embodiment. It is noted that the swash plate 26 constitutes a drive member for driving the pistons 38, while the rotary drive shaft 22, the drive source in the form of the vehicle engine and the torque transmitting device in the form of the hinge mechanism 30 cooperate with each other to constitute a major portion of a drive device for driving the drive member. The construction of each piston 38 will be described in detail.

The rear housing 18 indicated above has a suction chamber 50 and a discharge chamber 52, and the valve plate structure 16 has suction ports 54, suction valves 56, discharge ports 58 and discharge valves 60. The head portion 40 cooperates with the valve structure 16 to define a pressurizing chamber 61. A refrigerant gas in the suction chamber 50 is sucked or admitted into the pressurizing chamber 61 through the suction port 54 and the suction valve 56, when the piston 38 is moved from its upper dead point to its lower dead point, namely, in the suction stroke. The refrigerant gas in the pressurizing chamber 61 is pressurized by the piston 38 when the piston 38 is moved from its lower dead point to its upper dead point, namely, in the compression stroke. The thus pressurized refrigerant gas is delivered into the discharge chamber 52 through the discharge port 58 and the discharge valve 60.

The reciprocating stroke of the piston 38 and the discharge capacity of the compressor increase with an increase in the angle of inclination of the swash plate 26 (angle of the opposite surfaces of the swash plate 26 relative to a plane perpendicular to the axis of rotation of the drive shaft 22). The angle of inclination of the swash plate 26 is changed by controlling the pressure in the crank chamber 20 depending upon a load acting on the air conditioner. The crank chamber 20 and the suction chamber 50 communicate with each other through an exhaust passage 64, while the crank chamber 20 is connected to the discharge chamber 52 through an intake passage 64 which is provided with a capacity control valve 66.

The capacity control valve 66 is a solenoid-operated valve having a solenoid coil 68 which is selectively energized and de-energized by a control device (not shown) constituted principally by a computer. During energization of the solenoid coil 68, the amount of electric current applied to the solenoid coil 68 is controlled depending upon the air conditioner load, so that the amount of opening of the capacity control valve 66 is controlled according to the air conditioner load. Accordingly, the pressure in the crank chamber 20 is changed, so that a difference between the pressure in the crank chamber 20 which acts on the front and rear ends of the piston 38 and the pressure in the pressurizing chamber 61 is regulated to change the angle of inclination of the swash plate 26, for thereby changing the reciprocating stroke (suction and compression strokes), whereby the discharge capacity of the compressor can be adjusted. While the solenoid coil 68 is in the de-energized state, the capacity control valve 66 is held in its fully open state. The amount of opening of the capacity control valve 66 decreases with an increase in the amount of electric current applied to the solenoid coil 68. While the capacity control valve 66 is open, the pressurized refrigerant gas in the discharge chamber 52 is introduced into the crank chamber 20 through the intake passage 64 and the capacity control valve 66. By increasing the amount of electric current applied to the solenoid coil 68 to reduce the amount of opening the capacity control valve 66, the amount of the pressurized refrigerant gas to be introduced into the crank chamber 20 is reduced, so that the pressure in the crank chamber 20 is lowered to increase the angle of inclination of the swash plate 26, whereby the discharge capacity of the compressor is increased. When the amount of electric current applied to the solenoid coil 68 has increased to a given value, the capacity control valve 66 is fully closed, and the refrigerant gas in the crank chamber 20 is discharged into the suction chamber 50 through the exhaust passage 62, so that the pressure in the crank chamber 20 is lowered to maximize the angle of inclination of the swash plate 26, whereby the reciprocating stroke of the piston 38 is maximized to maximize the discharge capacity of the compressor. Therefore, the amount of opening of the capacity control valve 66 is reduced (or zeroed) with an increase in the air conditioner load, to increase the angle of inclination of the swash plate 26 and the discharge capacity of the compressor. In the present embodiment, the capacity control valve 66 and the control device for this control valve 66 cooperate to constitute a major portion of a swash plate angle adjusting device for adjusting the angle of inclination of the swash plate 26, or a discharge capacity control device for controlling the discharge capacity of the compressor.

The piston 38 will be described.

Figure 2:
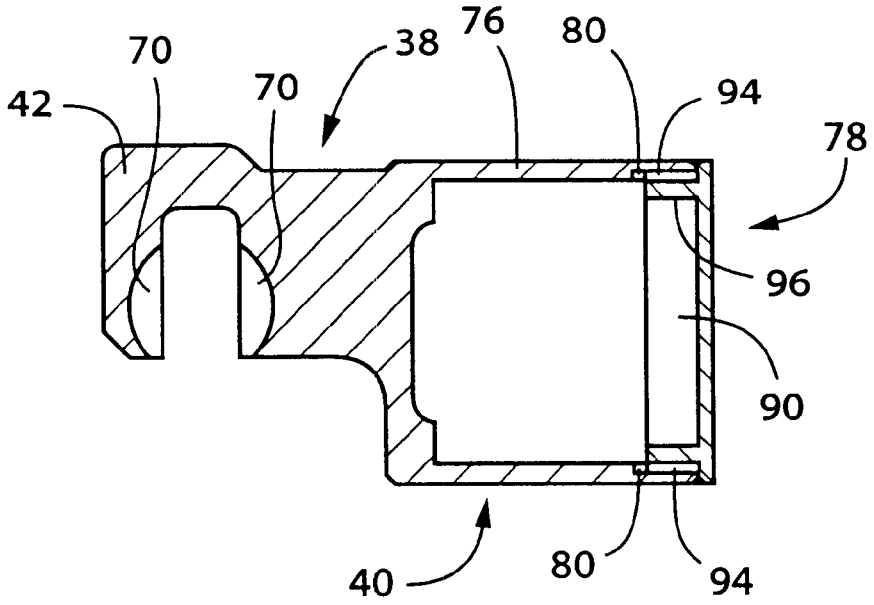
FIG. 2 is a front elevational view in cross section of the single-headed piston shown in FIG. 1.

The end portion of the neck portion 42 of the piston 38, which is remote from the head portion 40, has a U-shape in cross section, as shown in FIG. 2. The two opposed lateral walls of the U shape of that end portion has respective recesses 70 which are opposed to each other. Each of these recesses 70 is defined by a part-spherical inner surface of the lateral wall. The pair of shoes 46 indicated above are held in contact with the opposite surfaces of the swash plate 26 and are received in the respective part-spherical recesses 70. Thus, the neck portion 42 engage the swash plate 26 through the shoes 46. In the present embodiment, the neck portion 42 constitutes an engaging portion which engages the drive member in the form of the swash plate 26.

Figure 3:
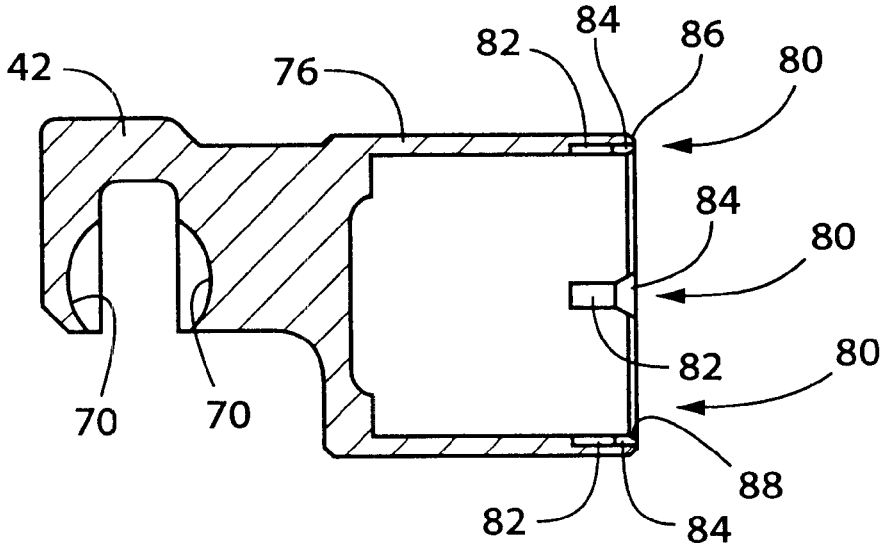
FIG. 3 is a front elevational view in cross section showing a neck portion and a body section of a head portion of the single-headed piston.
Figure 4:
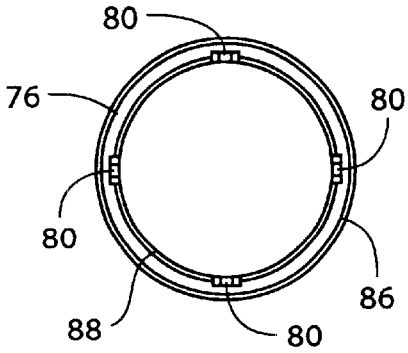
FIG. 4 is a right-hand side elevational view of the body section of the head portion shown in FIG. 3.

The head portion 40 of the piston 38 is formed integrally with the neck portion 42, and includes a cylindrical body portion 76 and a closure member 78 fixed to the body portion 76. The cylindrical body portion 76 is open at one of its opposite ends which is remote from the neck portion 42, and is closed at the other end. The closure member 78 closes the open end of the body portion 76. As shown in FIGS. 3 and 4, the open end portion of the inner circumferential surface of the hollow cylindrical section of the body portion 76 has a recessed portion in the form of a plurality of engaging grooves 80 (four engaging grooves 80 in this embodiment) formed so as to extend in the axial direction and so as to be open in the end face of the body portion 76, such that the engaging grooves 80 are arranged in the circumferential direction of the body portion 76, more precisely, equiangularly spaced from each other in the circumferential direction. Each engaging groove 80 consists of a straight portion 82 having a constant width and located remote from the open end of the body portion 76, and a tapered portion 84 which is located on the side of the open end and whose width linearly increases as it extends toward the open end. Further, the open end of the outer circumferential surface of the hollow cylindrical section of the body portion 76 has a chamfer 86, while the open end of the inner circumferential surface of that hollow cylindrical section has a chamfer 88, as shown in FIG. 3.

Figure 5:
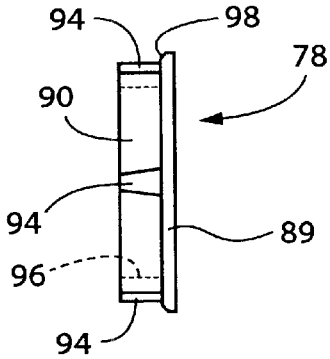
FIG. 5 is a front elevational view of a closure member of the single-headed piston of FIG. 2.
Figure 6:
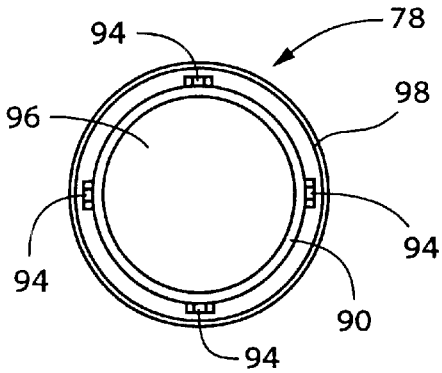
FIG. 6 is a left-hand side elevational view of the closure member of FIG. 5.

The closure member 78 is a generally disc-shaped member which consists of a circular plate portion 89, and a fitting portion 90 which extends from one of the opposite end faces of the plate portion 89. The fitting portion 90 has a non-circular shape in cross section taken in a plane parallel to the plate portion 89. That is, the fitting portion 90 has the non-circular shape, in the presence of a projecting portion in the form of a plurality of projections 94 (four projections 94 in this embodiment) formed on the outer circumferential surface of a cylindrical portion of the fitting portion 90, such that the projections 94 are arranged in the circumferential direction of the closure member 78, more precisely, equiangularly spaced from each other in the circumferential direction. Each projection 94 is tapered such that its circumferential dimension as measured in the circumferential direction of the closure member 78 decreases as the projection 94 extends in the axial direction away from the plate portion 89. The smallest circumferential dimension of the projection 94 at its free end is smaller than the width of the straight portion 82 of the engaging groove 80. The circumferential dimension increases in the direction from the free end to the fixed end, such that the circumferential dimension is larger at an intermediate part of the projection 94, than the width of the straight portion 82 of the engaging groove 80, and such that the maximum circumferential direction of the projection 94 at its fixed end is smaller than the maximum width of the tapered portion 84 of the engaging groove 80. When the closure member 78 is fitted in the open end portion of the body portion 76, the projection 94 is press-fitted into the corresponding engaging groove 80, with an interference fit. The outer circumferential surface of the cylindrical portion of the fitting portion 90 on which the projections 94 are formed has a diameter slightly larger than the diameter of the inner circumferential surface of the hollow cylindrical section of the body portion 76. The fitting portion 90 is press-fitted at the outer circumferential surface of its above-indicated cylindrical portion into the inner circumferential surface of the hollow cylindrical portion of the body portion 76, with an interference fit. Rotary movement of the closure member 78 relative to the body portion 78 is prevented primarily by the interference fit between the projections 94 and the engaging grooves 80, while axial movement of the closure member 78 away from the body portion 78 is prevented primarily by the interference fit between the outer circumferential surface of the cylindrical portion of the fitting portion 90 and the inner circumferential surface of the hollow cylindrical section of the body portion 76. The latter interference fit also contributes to an improvement in the concentricity of the closure member 78 with respect to the body portion 76. In addition, the fitting portion 90 has a circular recess 96 open in the end face of the closure member 78 remote from the plate portion 89, as shown in FIGS. 5 and 6, so that the weight of the closure member 78 is reduced. Further, the plate portion 89 has a chamber 98 at the periphery of its surface on the side of the fitting portion 90.

Figure 7:
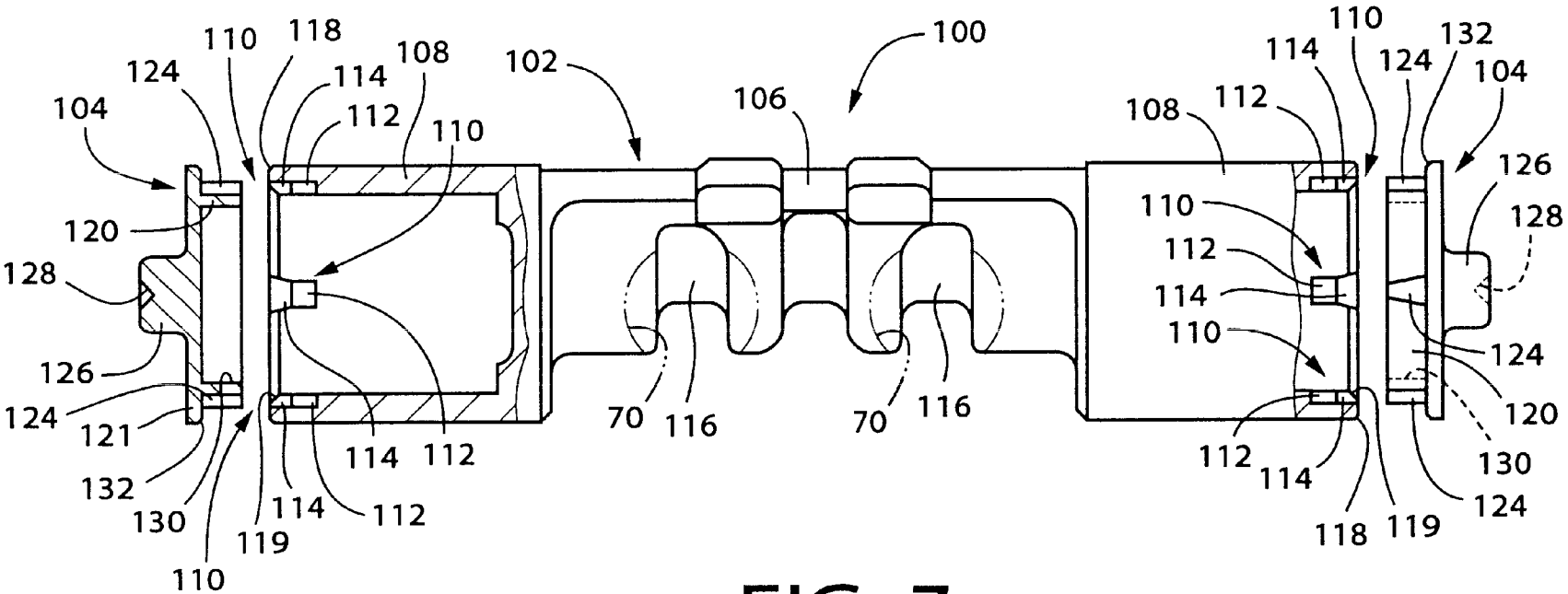
FIG. 7 is a front elevational view partly in cross section showing a blank used for manufacturing the single-headed piston of FIG. 2, before a closing member is fixed to a body member.

Two pieces of the piston 38 constructed as described above are produced from a single blank 100 shown in FIG. 7. The blank 100 used for producing the two pistons 38 has a body member 102 and two closure members 104. The body member 102 consists of a twin neck section 106 and two cylindrical hollow head sections 108 formed integrally with the twin neck section 106 such that the two hollow head sections 108 extend from the opposite ends of the twin neck section 106. The twin neck section 106 consists of mutually integrally formed two portions which correspond to the neck portions 42 of the two single-headed pistons 38. Each of the two hollow head sections 108 is closed at one of its opposite ends which is on the side of the twin neck section 106, and has a hollow cylindrical section which is open at the other end and which corresponds to the hollow cylindrical section of the head portion 40 of the piston 38.

As shown in FIG. 7, the open end portion of the inner circumferential surface of the hollow head section 108 has a recessed portion in the form of a plurality of engaging grooves 110 (four engaging grooves 110 in this embodiment) so as to extend in the axial direction and so as to be open in the end face of the hollow head section 108, such that the engaging grooves 110 are equally spaced from each other in the circumferential direction of the hollow head section 108. These engaging grooves 110 function as the engaging grooves 80 in the piston 38. Like the engaging groove 80, each engaging groove 110 consists of a straight portion 82 and a tapered portion 84. The body member 102 is formed by die-casting of a metallic material in the form of an aluminum alloy. This formation of the body member 102 by die-casting is a step of preparing the body member 102. Reference numeral 116 in FIG. 7 denotes a bridge portion provided for increasing the rigidity and strength of the body member 102. The open end of the outer circumferential surface of the hollow head section 108 has a chamfer 118, while the open end of the inner circumferential surface of that hollow head section 108 has a chamfer 119. These chamfers 118, 119 function as the chamfers 86, 88 of the body portion 76 of the head portion 40 of the piston 38.

The two closing members 104 are identical in construction with each other. Like the closure member 78, each of these closing member 104 includes a fitting portion 120 which extends from one of the opposite end faces of a plate portion 121. The fitting portion 120 has a projecting portion in the form of four projections 124 formed on its outer circumferential surface such that the projections 124 are equiangularly spaced from each other in the circumferential direction of the closing member 104. The projections 124 function as the projections 94 of the piston 38. Like the projection 124, each projection 94 is tapered such that its circumferential dimension as measured in the circumferential direction of the closing member 104 increases in the axial direction of the closing member 104 from the free end toward the fixed end, namely, from the end which first engages the engaging groove 110 toward the other end. The outer circumferential surface of the cylindrical portion of the fitting portion 120 on which the projections 124 are formed has a diameter slightly larger than the diameter of the inner circumferential surface of the hollow head section 108, for an interference fit of the cylindrical portion of the fitting portion 120 and the hollow head section 108. In addition, the fitting portion 120 of the closing member 104 has a circular recess 130, and the plate portion 121 has a chamber 132.

These recess 130 and chamfer 132 function as the recess 96 and the chamfer 98 of the closure member 78, respectively.

The plate portion 121 of each closing member 104 has a holding portion 126 in one of its opposite end faces remote from the fitting portion 120. The holding portion 126 has a circular shape in cross section, and has a center hole 128. In the present embodiment, the closing members 104 are formed by die-casting of a metallic material in the form of an aluminum alloy. This formation of the closing members 104 by die-casting is a step of preparing the closing members 104. The projections 124 and the engaging grooves 110 have the same dimensional relationship with each other as the projections 94 and the engaging grooves 80. The projections 124 are press-fitted into the corresponding engaging grooves 110 with an interference fit, as described above with respect to the projections 94 and grooves 80.

The two closing members 104 are fitted and fixed in the body member 102. Before the fitting is effected, an adhesive or bonding agent is applied to the mutually engaging surfaces of the closing members 104 and the body member 102, such as the outer circumferential surface of the fitting portion 120, and the inner circumferential surface of each cylindrical hollow head section 108 which engages the fitting portion 120. The adhesive agent preferably has a high heat resistance, and may be an epoxy resin or a polyimide resin, for example. The fitting portion 120 of each closing member. 104 is fitted in the inner circumferential surface of the open end portion of the cylindrical hollow head section 108 of the body member 102. To effect this fitting, the closing member 104 is positioned relative to the body member 102 in the circumferential direction so as to establish circumferential alignment between the four projections 124 and the four engaging grooves 110. Then, the fitting portion 120 is press-fitted into the open end portion of the hollow head section 108, with an interference therebetween, while the fitting portion 120 is guided by the chamfer 119. In the process of this press fitting, the projections 124 are press-fitted into the engaging grooves 110, with an interference therebetween. The projections 124 initially engage the tapered portion 114 of the corresponding engaging grooves 110, and are inserted into the grooves 110 while being guided by the tapered side surfaces of the tapered portion 114. In this example, the tapered portion 114 provides a guiding portion for guiding the projection 124 into the corresponding engaging groove 110.

Figure 8:
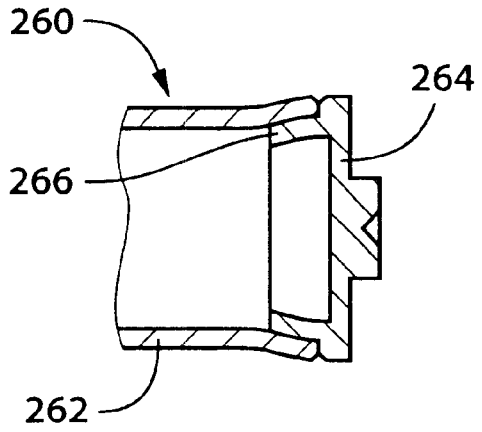
FIG. 8 PRIOR ART
FIG. 8 is a fragmentary front elevational view in cross section showing a conventional blank for a single-headed piston, after a closing member is fixed to a body member.
Figure 9:
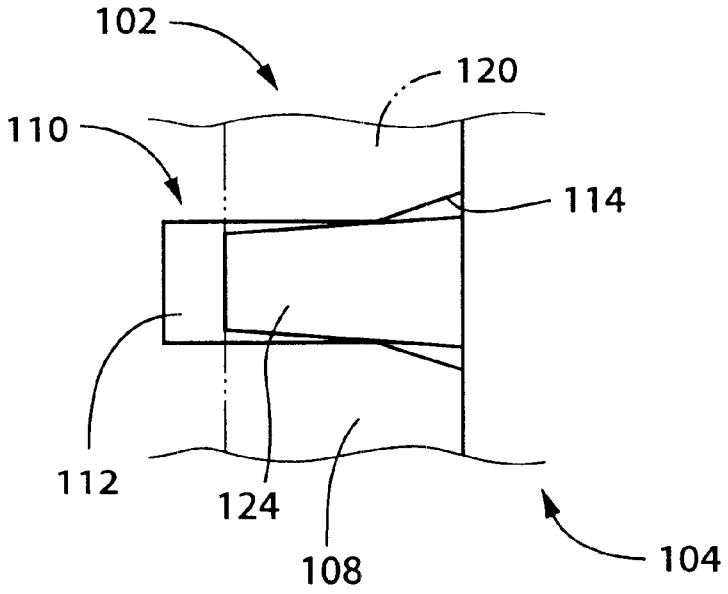
FIG. 9 is a development view showing the blank of FIG. 7 when projections of the closure member engage grooves of the body member.

The fitting portion 120 is fitted into the body member 102 until the end face of the plate portion 121 remote from the holding portion 126 is brought into abutting contact with the open end face of the hollow head section 108 of the body member 102, as shown in FIG. 9. The circumferential dimension of the projection 124 at an intermediate portion between the distal and proximal ends is made larger than that of the straight portion 112 of the engaging groove 110, so that an interference fit is effected between the intermediate portion of the projection 124 and one of the opposite ends of the straight portion 112 which is on the side of the open end of the hollow head section 108, as shown in FIG. 9. This interference fit between the projections 124 and the engaging grooves 110 primarily functions to prevent relative rotation of the closing member 104 and the body member 102, and the engagement between the fitting portion 120 of the closing member 104 and the hollow head section 108 of the body member 102 primarily functions to prevent removal of the closing member 104 away from the body member 102, and to assure a high degree of concentricity of these members 102, 104 relative to each other. Thus, the interference fit between the projections 124 and the engaging grooves 110 increases the boding strength between the closing members 104 and the body member 102, and reduces the required amount of interference between the outer circumferential surface of the fitting portion 120 (except those areas on which the projections 124 are formed) and the inner circumferential surface of the cylindrical hollow head portion 108 of the body member 102. FIG. 8 shows a fitting portion 266 of a closing member 264 which does not have the projections 124 and which is fitted at its outer circumferential surface in the inner circumferential surface of a cylindrical hollow head portion 262 of a body member 260 which does not have the engaging grooves 110. Where the relative rotation of the closing member 264 and the body member 260 is to be prevented by a force of friction generated by the interference fit between the fitting portion 266 and the hollow head portion 262, the amount of the interference fit must be considerably large, resulting in an excessively large amount of expansion of the hollow head section 262 of the body member 260 in the radial direction due to the interference. In the present embodiment wherein the relative rotation of the body member 102 and the closing member 104 is prevented by the engagement between the projections 124 and the engaging grooves 110, the amount of interference between the outer circumferential surface of the fitting portion 120 and the inner circumferential surface of the hollow head portion 108 need not be so large for the purpose of preventing the relative rotation, making it possible to minimize the amount of radial expansion of the hollow head section 108 of the body member 102.

Figure 10:
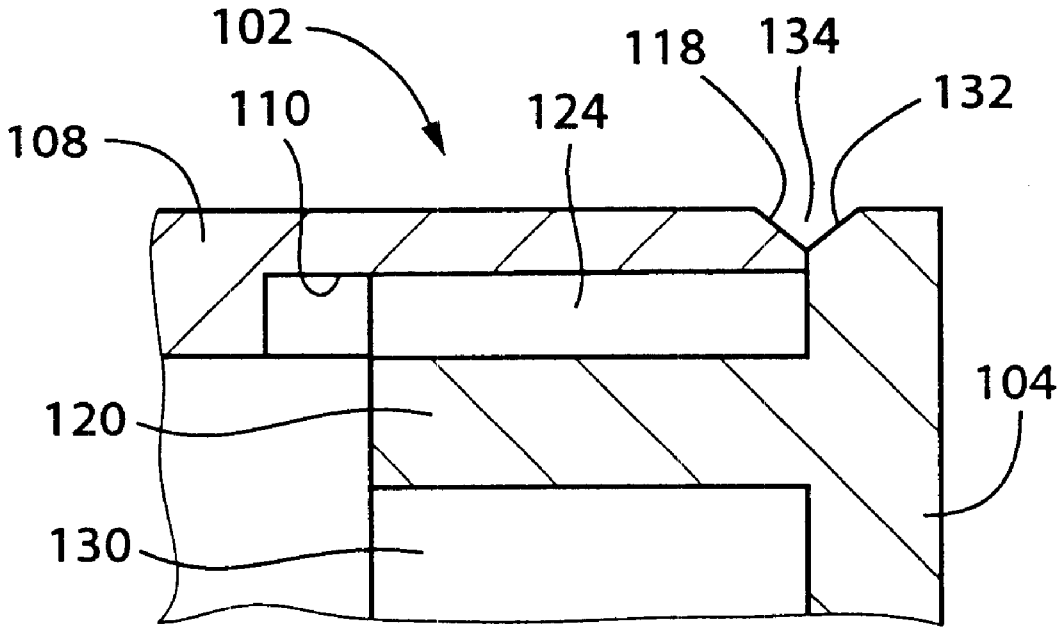
FIG. 10 is a fragmentary front elevational view showing the body member and the closing member of the blank of FIG. 7 whose chamfers cooperate to define a groove.

With the projections 124 being press-fitted into the engaging grooves 110 as described above, there exists a given amount of interference between the side surfaces of each projection 124 and the corresponding groove 110, which side surfaces are parallel to the direction of extension of the projection 124 and groove 110, as indicated in FIG. 9, so as to prevent the relative rotation of the body member 102 and the closing members 104 and the relative axial movement of these members 102, 104, whereby the closing members 104 are fixed to the body member 102 such that the open end of the hollow head section 108 remote from the twin neck section 106 is closed by the closing member 104. Further, the adhesive agent applied to the closing members 104 and the body member 102 assures firm fixing of the closing members 104 to the body member 102. Thus, the step of fixing the closing members 104 to the body member 102 is effected in the present embodiment. It is noted that a groove 143 which is V-shaped in cross section is formed by the chamfers 118, 132 as a result of the step of fixing the closing members 104 to the body member 102, as shown n FIG. 10.

In the present embodiment, the body member 102 and the closing members 104 are both formed by die-casting. Since the die-casting permits a high degree of dimensional accuracy of the body member 102 and the closing members 104, the closing members 104 can be fitted in the body member 102, without prior mechanical operations such as machining or grinding operations, so that the blank 100 for the single-headed pistons can be economically manufactured. However, machining operations may be performed prior to the fitting of the fitting portion 120 in the body member 102, at suitable positions as needed, for example, on the annular end faces at the open ends of the cylindrical hollow head sections 108, and the corresponding annular portion of the end face of the plate portion 121 of each closing member 104, which annular portion is located radially outwardly of the fitting portion 120 and which is brought into abutting contact with the annular end face of the corresponding hollow head section 108.

After the two closing members 104 are fitted in the body member 102 as described above, a machining operation is performed on the outer circumferential surfaces of the hollow head sections 108 of the body member 102 and the exposed outer circumferential surfaces of the closing members 103, which provide the head portions 40 of the two pistons 38. This machining operation is effected on a lathe or turning machine such that the blank 100 is held by chucks at the holding portions 126 of the closing members 104, with the blank 100 being centered with two centers engaging the center holes 128, and such that the blank 100 is rotated by a suitable drive device. Since the closing members 104 are fixed to the body member 102 so as to prevent the relative rotation as described above, a torque applied to each closing member 104 is transmitted to the body member 102, without the relative rotation therebetween, so that the blank 100 can be turned as a whole for efficient machining on its outer circumferential surface.

Then, the outer circumferential surfaces of the hollow head sections 108 of the body member 102 and the closing members 104 are coated with a suitable material, such as a film of polytetrafluoroethylene. At this time, the groove 134 is filled with the polytetrafluoroethylene, so as to cover the seam between the closing members 104 and the body member 102, and to prevent a flow of a gas into the hollow head sections 108. The blank 100 is then subjected to a machining operation to cut off the holding portions 126 from the closing members 104, and a grinding operation on the coated outer circumferential surfaces of the hollow head sections 108 and the closing members 104. In the next step, a cutting operation is performed near the two bridge portions 116 of the twin neck section 106, to form the recesses 70 in which the shoes 46 of the pistons 38 are received. Thus, the two portions which provide the neck portions 42 of the two pistons 38 are formed at the twin neck section 106. Finally, the twin neck section 106 is subjected at its axially central position to a cutting operation to cut the blank 100 into two pieces which provide the respective two pistons 38.

In the present embodiment described above, the body member 102 of the blank 100 has the recessed portion in the form of the engaging grooves 104 to provide the engaging grooves 78 of the closure member 78 of each piston 38, while the closing members 104 have the projecting portion in the form of the projections 124 to provide the projections 94 of the closure member 78 of each piston 38. However, body member 102 has the projecting portion while the closing members 104 have the recessed portion. An example of this modification is shown in FIGS. 11–14 wherein the same reference signs as used for the body member 102 and closing members 104 are used to identify the functionally corresponding elements. No redundant description of these elements will be provided. Although one of the body member and each closing member has a chamfer for guiding the projecting portion of the closing member into the cylindrical hollow section of the body member, this chamfer is not shown in FIGS. 11–14. The same applies to embodiments of FIG. 15 and the following figures.

Figure 11:
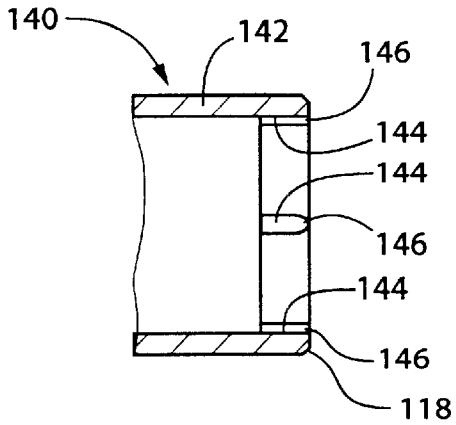
FIG. 11 is a fragmentary front elevational view showing an open end portion of a hollow head section of a body member of a blank produced by a method according to another embodiment of this invention.
Figure 12:
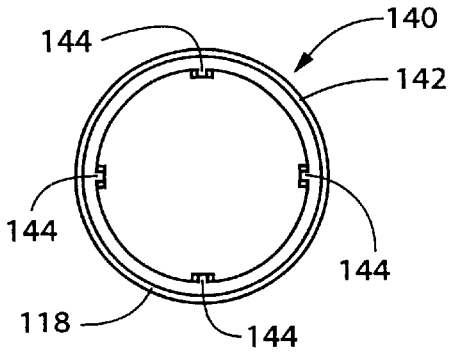
FIG. 12 is a right-hand side elevational view of the hollow head section shown in FIG. 11.

As shown in FIGS. 11 and 12, the blank for single-headed pistons includes a body member 140 whose cylindrical hollow head section 142 has a projecting portion in the form of a plurality of projections 144 formed on the inner circumferential surface of its open end portion. In this specific example, four projections 144 are formed such that the four projections 144 are equiangularly spaced from each other in the circumferential direction of the body member 140. Each projection 44 has a constant dimension as measured in the circumferential direction indicated above, and a guide portion 146 in the form of a chamfer formed at its end on the side of the open end of the hollow head section 142.

Figure 13:
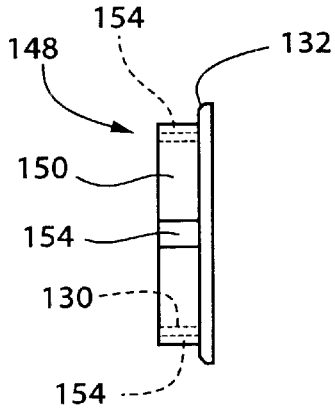
FIG. 13 is a front elevational view of a closing member which cooperates with the body member of FIG. 11 to constitute the blank.
Figure 14:
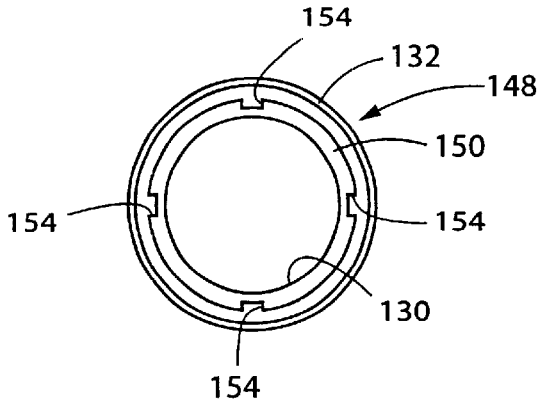
FIG. 14 is a left-hand side elevational view of the closing member of FIG. 13.

The blank also includes two closing members 148 each including a fitting portion 150 which has a recessed portion in the form of four engaging grooves 144 open in its outer circumferential surface, as shown in FIGS. 13 and 14. The engaging grooves 144 extend in the axial direction and are equiangularly spaced from each other in the circumferential direction of the fitting portion 150. Each engaging groove 154 has a constant dimension as measured in the circumferential direction, which is slightly smaller than that of the projections 144.

To fix the closing members 148 to the body member 140, the engaging portion 150 is press-fitted into the hollow head section 142 while the four projections 144 are held in alignment with with the respective engaging grooves 154, so that the projections 144 are press-fitted into the respective engaging grooves 154, while the projections 144 are guided by the guide portions 146.

Figure 15:
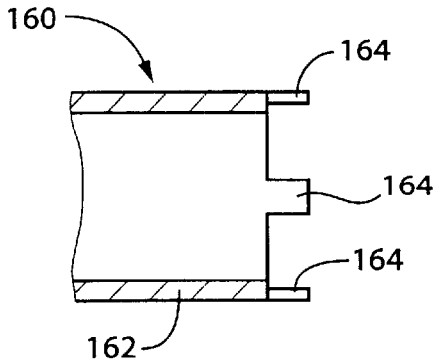
FIG. 15 is a front elevational view in cross section showing an open end portion of a hollow head section of a body member of a blank produced by a method according to a further embodiment of this invention.
Figure 16:
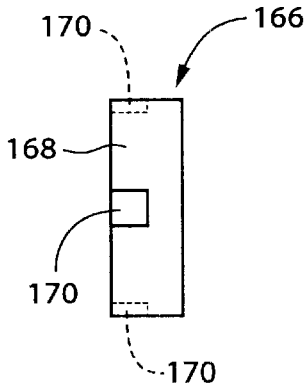
FIG. 16 is a front elevational view of a closing member which cooperates with the body member of FIG. 15 to constitute the blank.

FIGS. 15 and 16 respectively show a body member 160 and a closing member 166, which have a projecting portion and a recessed portion, respectively. The projecting portion takes the form of four projections 164 which extend from the open end face of a hollow head section 162 of the body member 160, in the axial direction of the hollow head section 162. The four projections 164 are equiangularly spaced from each other in the circumferential direction of the hollow head section 162. On the other hand, the recessed portion takes the form of four engaging grooves 170 open in its outer circumferential surface and extending in the axial direction. These four engaging grooves 170 are also equiangularly spaced from each other in the circumferential direction. Each projection 164 has a circumferential dimension slightly larger than that of the engaging groove 170, so that the projection 162 is press-fitted into the corresponding engaging groove 170. One of the corresponding projection and groove 164, 170 has a guide portion in the form of a chamfer.

The projecting portion and the recessed portion which are provided on one and the other of the outer circumferential surface of the fitting portion of the closing member and the inner circumferential surface of the hollow head section of the body member may be arranged to be brought into fitting engagement with each other by a snap action. An example of this modification will be explained by reference to FIGS. 17 and 19.

Figure 17:
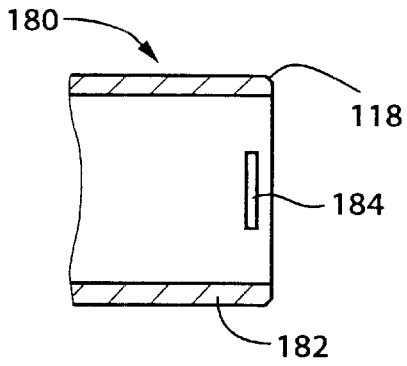
FIG. 17 is a front elevational view in cross section showing an open end portion of a hollow head section of a body member of a blank produced by a method according to a still further embodiment of this invention.
Figure 18:
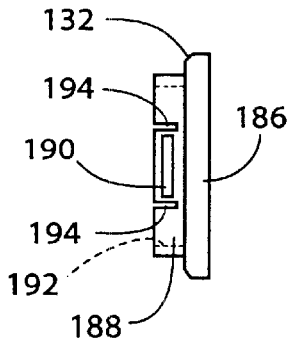
FIG. 18 is a front elevational view of a closing member which cooperates with the body member of FIG. 17 to constitute the blank.
Figure 19:
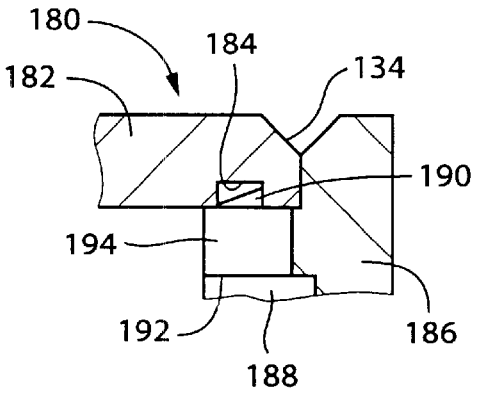
FIG. 19 is a front elevational view showing engagement of grooves of the body member of FIG. 17 with projections of the closing member of FIG. 18.

In the embodiment of FIGS. 17–19, a blank for the single-headed pistons includes a body member 180 whose cylindrical hollow head section 182 has a recessed portion in the form of three engaging grooves 184 formed in the open end portion of its inner circumferential surface, as shown in FIG. 17 (wherein only one groove 184 is shown). These three engaging grooves 184 are equiangularly spaced from each other in the circumferential direction of the hollow head section 182. Each engaging groove 184 is elongated extending in the circumferential direction of the hollow head section 182, and has a rectangular shape in cross section taken in a plane perpendicular to the axial direction of the hollow head section 182, as shown in FIG. 19.

The blank further includes two closing members 186 each including a fitting portion 188 which has a projecting portion in the form of three engaging projections 190 formed on its outer circumferential surface, as shown in FIG. 18 (wherein only one projection 190 is shown). These three projections 190 are equiangularly spaced from each other in the circumferential direction of the fitting portion 188. Each projection 190 is elongated extending in the circumferential direction of the fitting portion 188, and has a triangular shape in cross section taken in a plane perpendicular to the axial direction of the closing member 186, as shown in FIG. 19. Namely, the amount of radial extension of each projection 190 from the outer circumferential surface of the fitting portion 188 decreases in the axial direction from proximal end toward the distal end of the fitting portion 188. The axial and circumferential dimensions of each engaging groove 184 as measured in the axial and circumferential directions of the body member 180 are determined so that the corresponding projection 190 can be accommodated in the engaging groove 184. The fitting portion 188 of each closing member 186 has a circular recess 192, so that the fitting portion 188 has an annular shape. The annular fitting portion 188 has three pairs of radial cutouts 194, which are formed through the entire thickness of the annular wall of the annular fitting portion 188 and which have a depth from the annular end face of the fitting portion 188 in the axial direction. The two radial cutouts 194 of each pair are located on the circumferentially opposite sides of the corresponding one of the three projections 190.

To fix the closing member 186 to the body member 180, the annular fitting portion 188 is press-fitted into the hollow head section 182, while the projections 190 are snapped into the respective engaging grooves 184. At this time, the hollow head section 182 is elastically deformed by the annular fitting portion 188, so as to radially outwardly expand, while each projection 190 formed between the pair of cutouts 194 is easily elastically deformed radially inwardly, so that each projection 190 is easily snapped into the corresponding engaging groove 184. Since the amount of radial extension of the projection 190 from the outer circumferential surface of the fitting portion 188 decreases in the axial direction toward the distal end of the fitting portion 188, the end portion of the hollow head section 182 of the body member 180 and each circumferential part of the fitting portion 188 interposed between the corresponding pair of radial cutouts 194 are gradually deformed radially outwardly and inwardly as the fitting portion 188 is axially moved relative to the hollow head section 182 until the projections 190 are snapped into the respective grooves 184, with spring-back movements of the hollow head section 182 and the above-indicated circumferential parts of the fitting portion 188. Thus, the projections 190 are accommodated in the respective grooves 184, such that the surfaces of the projections 190 parallel to the axial direction of the fitting portion 188 are held in engagement with the surfaces of the grooves 184 parallel to the axial direction of the hollow head section 182, thereby preventing relative rotation of the body member 180 and the closing member 186, and such that the surfaces of the projections 190 perpendicular to the axial direction are held in engagement with the surfaces of the grooves 184 perpendicular to the axial direction, thereby preventing removal of the closing member 186 from the body member 180.

Figure 20:
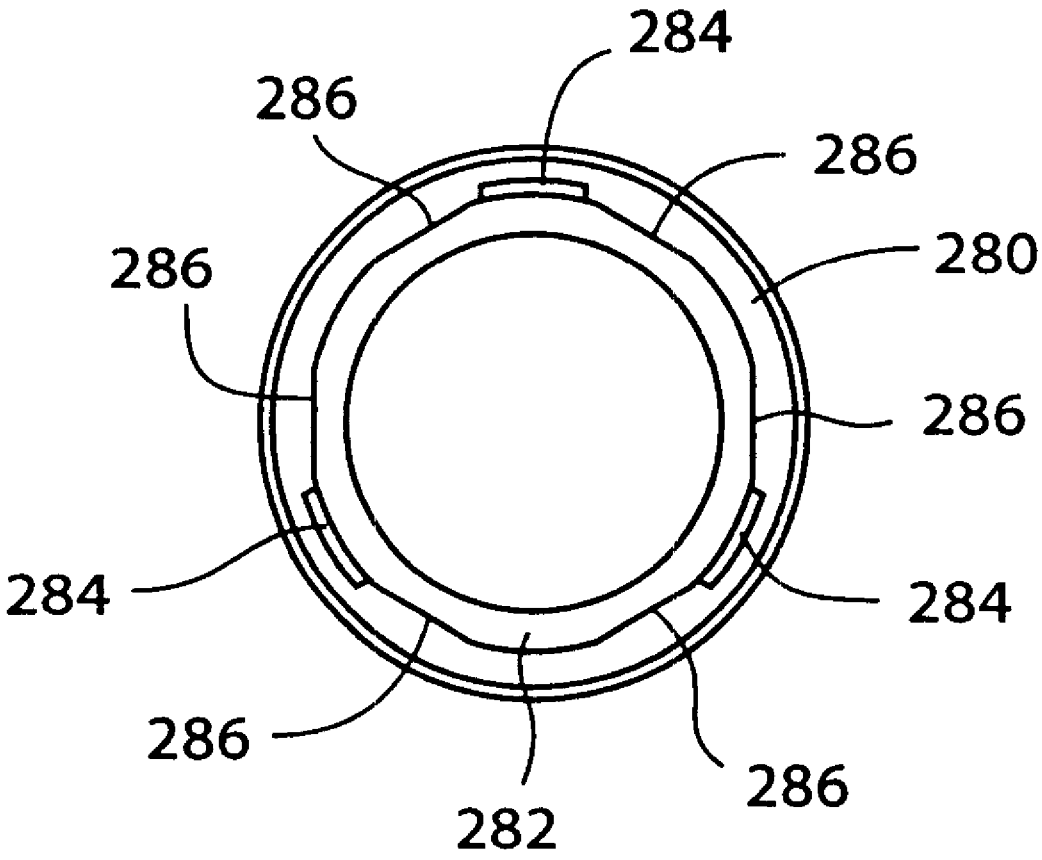
FIG. 20 is a left-hand side elevational view of a closing member of a blank produced according to a yet further embodiment of this invention.

Another embodiment utilizing a snap action for engagement of the projecting portion and the recessed portion with each other is shown in FIG. 20, wherein a closing member 280 has three projections 284 formed on the outer circumferential surface of an annular fitting portion 282, and three pairs of cutouts 286 in the form of generally flat faces, each pair being located adjacent to the opposite circumferential ends of the corresponding one of the three projections 284. Each projection 284 is similar in configuration to the projection 190 of FIG. 18. Like the body member 180, the body member (not shown) in which the closing member 280 is fitted has three engaging grooves open in the inner circumferential surface of its hollow head section. When the fitting portion 282 is fitted into the hollow head section, the parts of the hollow head section in which the engaging grooves are formed are elastically deformed in the radial outward direction. At this time, the cutouts 286 permit radially inward elastic deformation of the other parts of the hollow head section that are circumferentially adjacent to the above-indicated radially outwardly deformed parts. Thus, the elastic deformation of the hollow head section is facilitated by the cutouts 286. Namely, the engagement of the projections 284 with the engaging grooves is permitted by the elastic deformation of the hollow head portion, rather than elongation of the hollow head portion, so that the fitting portion 282 of the closing member 280 can be easily fitted in the hollow head section of the body member.

The closing member and the body member may be brought into engagement with each other, by engagement of the closing member with protrusions which are formed by forcing local parts of the hollow head section of the body member in the radially inward direction. An example of this arrangement will be explained by reference to FIGS. 21 and 22.

Figure 21:
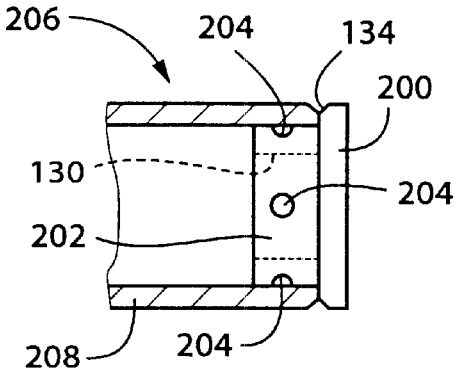
FIG. 21 is a fragmentary front elevational view partly in cross section showing engagement of a hollow head section of a body member with projections of a closing member, in a blank produced according to still another embodiment of this invention.
Figure 22:
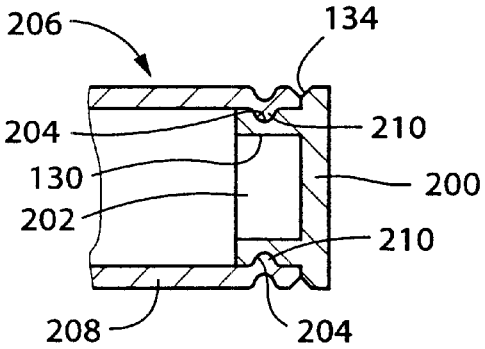
FIG. 22 is a front elevational view showing engagement of the body member and the closing member of FIG. 21 such that these member are not rotatable relative to each other.

In the embodiment of FIGS. 21 and 22, the blank includes a closing member 200 having a fitting portion 202 which has a plurality of recesses, for instance, four recesses 204 formed in its outer circumferential surface such that the four recesses 204 are equiangularly spaced from each other in the circumferential direction of the fitting portion 202. The fitting portion 202 is first fitted in the inner circumferential surface of a cylindrical hollow head section 208 of a body member 206 of the blank, such that the annular portion of the end face of the closure member 200 which is radially outwardly of the fitting portion 202 is in abutting contact with the end face of the hollow head section 208, as shown in FIG. 21. In this condition, parts of the hollow head section 208 corresponding to the recesses 204 are radially inwardly forced at the outer circumferential surface by a suitable punching tool, so that the corresponding parts of the inner circumferential surface of the hollow head section 208 are radially inwardly forced out by plastic deformation, so as to form a projecting portion in the form of protrusions 210, such that the protrusions 210 protrude into the respective recesses 204, as shown in FIG. 22. This engagement of the protrusions 210 and the recesses 204 prevents relative rotation and axial movement of the closing member 200 and the body member 206.

The relative rotation of the closing member and the body member may be prevented by providing a multiplicity of projections formed on at least one of the outer circumferential surface of the fitting portion of the closing member and the inner circumferential surface of the hollow head section of the body member, such that the projections are formed over the entire circumference of the fitting portion and/or hollow head section. The relative rotation can be prevented by engagement of the projections on one of the inner and outer circumferential surfaces with the projections on the other circumferential surface, or with the other circumferential surface. An example of this arrangement will be explained by reference to FIGS. 23 and 24.

Figure 23:
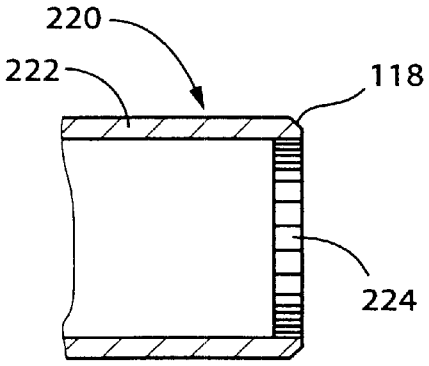
FIG. 23 is a fragmentary front elevational view in cross section of an open end portion of a hollow head section of a body member of a blank produced by a method according to yet another embodiment of this invention.
Figure 24:
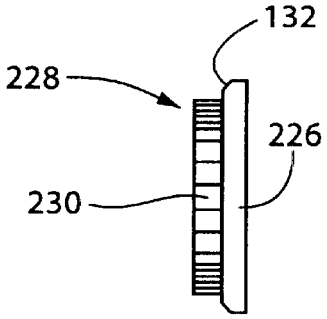
FIG. 24 is a front elevational view of a closing member which cooperates with the body member of FIG. 23 to constitute the blank.

In the embodiment of FIGS. 23 and 24, the blank includes a body member 220 whose hollow head section 222 has a serration 224 formed in the end portion of its inner circumferential surface, as shown in FIG. 23. The blank also includes a closing member 226 having a fitting portion 228 which has a serration 230 formed on its outer circumferential surface, as shown in FIG. 24. Namely, the end portion of the inner circumferential surface of the hollow head section 222 is serrated over its entire circumference, and the outer circumference surface of the fitting portion 228 is serrated over its entire circumference. To fix the closing member 226 to the body member 220, these two members 226, 220 are positioned relative to each other in the circumferential direction such that projections of one of the serrations 224, 230 are aligned with recesses of the other serration. Then, the fitting portion 228 is fitted into the hollow head section 222, so that the projections of each serration 224, 230 are held in a forced engagement with the recesses of the other serration with an interference therebetween, so as to prevent the relative rotation of the body member 220 and the closing member 226.

Figure 25:
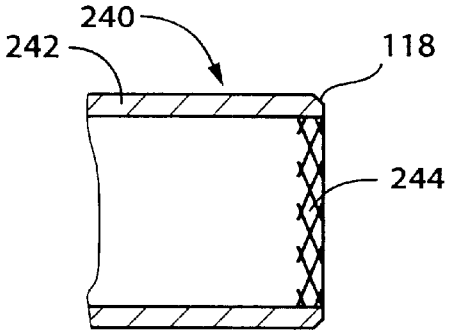
FIG. 25 is a fragmentary front elevational view in cross section of an open end portion of a hollow head section of a body member of a blank produced by a method according to a further embodiment of this invention.
Figure 26:
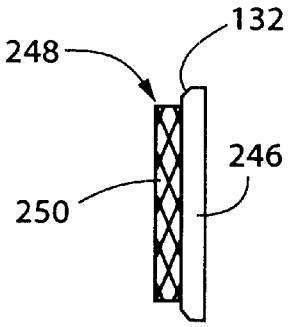
FIG. 26 is a front elevational view of a closing member which cooperates with the body member of FIG. 25 to constitute the blank.

A further embodiment of this invention is shown in FIGS. 25 and 26, wherein a hollow head section 242 of a body member 240 has a knurled inner circumferential surface 244 at its open end portion, while a fitting portion 248 of a closing member 246 has a knurled outer circumferential surface 250. Namely, the inner circumferential surface 244 of the hollow head section 242 is knurled over its entire circumference, while the outer circumferential surface 250 of the fitting portion 248 is knurled over its entire circumference. To fix the closing member 246 to the body member 240, the knurled outer circumferential surface 240 is forced into engagement with the knurled inner circumferential surface 244, with an interference therebetween, so as to prevent relative rotation of the closing member 246 and the body member 240.

In the illustrated embodiments, the body member 102, etc. and the closing member 104, etc. are brought into engagement with each other at the projecting and recessed portions, and bonded together by an adhesive agent. However, the closing member and the body member may be bonded together by an alloy having a lower melting point than those members, such as a soldering or brazing material, in place of an adhesive agent, or alternatively by welding such as an electron beam welding.

The closing member and the body member may be fixed together by bonding using an adhesive agent or a low-melting-point alloy, or by an electron beam welding or other welding method, without engagement between a projecting portion and a recessed portion.

In the first embodiment of FIGS. 1-10, the projections 124 to provide the projections 94 are tapered, the projections may be straight projections having a constant circumferential dimension in the axial direction of the closing member 104. Further, the recessed portion may be tapered over its entire axial length. In this case, the projecting portion may be either tapered or straight. In addition, the recessed portion may be straight over its entire axial length. In this case, too, the projecting portion may be either tapered or straight.

Although two single-headed pistons are manufactured from each blank in each of the illustrated embodiments which have been described, the aspect of this invention relating to the fitting of the closing member in the body member by means of engagement between the projecting portion and the recessed portion so as to prevent relative rotation of the two members is equally applicable to a blank from which only one single-headed piston is manufactured, and a method of manufacture of the piston from such a blank, as described above in the SUMMARY OF THE INVENTION.

While some presently preferred embodiments of this invention have been described above, for illustrative purpose only, it is to be understood that the present invention may be embodied with various changes and improvements such as those described in the SUMMARY OF THE INVENTION, which may occur to those skilled in the art.

What is claimed is:

1. A method of producing a blank for manufacturing a single-headed piston including a head portion and a neck portion which is formed integrally with said head portion, for engagement with a drive member, said method being characterized by comprising the steps of:

manufacturing a body member including a neck section and a hollow head section which is formed integrally with said neck section and which is open at one of opposite ends thereof which is remote from said neck section, said body member having one of a projecting portion and a recessed portion;

manufacturing a closing member for closing an open end of said hollow head section, said closing member having the other of said projecting and recessed portions; and fixing said closing member to said body member such that relative rotation of said body member and said closing member is prevented by engagement of said projecting and recessed portions.

2. A method according to claim 1, wherein said closing member is formed such that said closing member includes a fitting portion having an outer circumferential surface to be fitted in an inner circumferential surface of said hollow head section, and said closing member and said body member are formed such that one of said outer circumferential surface of said fitting portion and said inner circumferential surface of said hollow head section has said projecting portion which is formed thereon so as to extend in an axial direction of said fitting portion and said hollow head section, while the other of said outer circumferential surface and said inner circumferential surface has said recessed portion for engagement with said projecting portion, said step of fixing a closing member to said body member comprising fitting said fitting portion of said closing member in said hallow head section of said body member at said outer and inner circumferential surfaces while effecting engagement of said projecting and recessed portions with each other.

3. A method according to claim 2, wherein at least one of said projecting and recessed portions has a guide portion at one end thereof at which the engagement of said projecting and recessed portions is initiated, said guiding portion being shaped to guide said projecting portion into said recessed portion.

4. A method according to claim 2, wherein said projecting portion is shaped such that a circumferential dimension of said projecting portion as measured in a circumferential direction of said closing member and said hollow head section increases in said axial direction from one end of said projecting portion at which the engagement of said projecting and recessed portions is initiated, toward the other end of said projecting portion.

5. A method according to claim 1, wherein said closing member is formed such that said closing member includes a fitting portion having an outer circumferential surface to be fitted in an inner circumferential surface of said hollow head section, and said closing member and said body member are formed such that one of said outer circumferential surface of said fitting portion and said inner circumferential surface of said hollow head section has said projection portion, while the other of said outer circumferential surface and said inner circumferential surface has said recessed portion for engagement with said projecting portion, said projecting and recessed portions being shaped such that said projecting portion is snapped into said recessed portion, with elastic deformation of at least one of said hollow head section and said fitting portion of said closing member in a radial direction thereof, and such that the engagement of said projecting and recessed portions prevents a relative movement thereof in a circumferential direction of said fitting portion and said hollow head section.

6. A method according to claim 1, wherein said closing member is formed such that said closing member includes a fitting portion having an outer circumferential surface to be fitted in an inner circumferential surface of said hollow head section, said fitting portion further having as said recessed portion at least one recess which is not continuous in a circumferential direction of said hollow head section, and said step of manufacturing a body member and said step of fixing a closing member to said body member comprise fitting said fitting portion into said hollow head section, and forcing at least one part of said hollow head section corresponding to said at least one recess in a radially inward direction of said hollow head section by plastic deformation, to form as said projecting portion at least one projection which engages said at least one recess, respectively.

7. A method according to claim 1, wherein said closing member is formed such that said closing member includes a fitting portion having an outer circumferential surface to be fitted in an inner circumferential surface of said hollow head section, and said step of manufacturing a body member and said step of manufacturing a closing member comprise forming, as said projecting portion, a multiplicity of projections on each of at least one of said outer circumferential surface of said fitting portion and said inner circumferential surface of said hollow head section over an entire circumference thereof, said step of fixing a closing members to said body member comprising fitting said fitting portion in said inner circumferential surface of said hollow head section such that said multiplicity of projections formed on each of said at least one of said outer and inner circumferential surfaces are held in forced engagement with the other of said outer and inner circumferential surfaces, with an interference therebetween.

8. A method according to claim 7, wherein said multiplicity of projections are formed by knurling said at least one of said outer and inner circumferential surfaces over the entire circumference.

9. A method according to claim 7, wherein said multiplicity of projections are formed by serrating said at least one of said outer and inner circumferential surfaces over the entire circumference.

10. A method according to claim 1, wherein said step of fixing comprises bonding said closing member to said body member by an adhesive agent.

11. A method according to claim 1, wherein said step of fixing a closing member comprises bonding said closing member to said body member by an alloy having a melting point lower than melting points of alloys of said closing member and said body member.

12. A method according to claim 1, wherein said step of fixing a closing member comprises welding said closing member to said body member.

13. A method according to claim 1, wherein said step of manufacturing a body member comprises manufacturing a body member including a twin neck section and two cylindrical hollow head sections formed integrally with said twin neck section such that said two hollow head sections extend from opposite ends of said twin neck section, said twin neck section consisting of two portions which are mutually integrally formed in series with each other and which correspond to the neck portions of respective two single-headed pitons, each of said two hollow head sections being open at at least one of opposite ends thereof which is remote from said twin neck section, and said step of manufacturing a closing member comprises manufacturing two closing members each for closing an open end of a corresponding one of said two hollow head sections, and said step of fixing said closing member to said body member comprising fixing each of said two closing members to said body member, so as to close said open end of said corresponding hollow head section.

14. A blank for manufacturing a single-headed piston including a head portion and a neck portion which is formed integrally with said head portion, for engagement with a drive member, said blank comprising:

a body member including a neck section and a hollow head section which is formed integrally with said neck section and which is open at one of opposite ends thereof which is remote from said neck section, said body member having one of a projecting portion and a recessed portion; and a closing member which closes an open end of said hollow head section and which has the other of said projecting and recessed portions, said closing member being fixed to said body member such that relative rotation of said body member and said closing member is prevented by engagement of said projecting and recessed portions.

15. A blank according to claim 14, wherein said blank comprises a body member including a twin neck section and two cylindrical hollow head sections formed integrally with said twin neck section such that said two hollow head sections extend from opposite ends of said twin neck section, said twin neck section consisting of two portions which are mutually integrally formed in series with each other and which correspond to the neck sections of two single-headed pistons, each of said two hollow head sections being open at at least one of opposite ends thereof which is remote from said twin neck section, and two closing members fixed to said body member such that each of said two closing members closes an open end of a corresponding one of said two hollow head sections.

* * * * *

UNITED STATES PATENT AND TRADEMARK OFFICE

CERTIFICATE OF CORRECTION

PATENT NO. : 6,395,404 B1
DATED : May 28, 2002
INVENTOR(S) : Kato et al.

It is certified that error appears in the above-identified patent and that said Letters Patent is hereby corrected as shown below:

Column 3,
Line 60, after "piston" insert a comma -- , --

Column 16,
Line 49, after "shown" the "n" should be -- in --

Signed and Sealed this

Seventeenth Day of September, 2002

*Attest:*

*Attesting Officer*

JAMES E. ROGAN
*Director of the United States Patent and Trademark Office*